United States Patent [19]

Wallace

[11] 4,055,852

[45] Nov. 1, 1977

[54] DISPOSABLE RAIN PROTECTOR

[76] Inventor: William E. Wallace, 1851 Arlington St., Sarasota, Fla. 33579

[21] Appl. No.: 639,452

[22] Filed: Dec. 10, 1975

[51] Int. Cl.[2] ..... A41D 9/00

[52] U.S. Cl. ..... 2/84; 428/409

[58] Field of Search ..... 2/82, 84, 89, 202, 198; 427/12, 13; 428/409; 307/88 ET

[56] References Cited

U.S. PATENT DOCUMENTS

| | | | |
|---|---|---|---|
| 1,398,165 | 11/1921 | Whiteside | 2/88 |
| 2,837,746 | 6/1958 | Gundy | 2/198 |
| 3,347,362 | 10/1967 | Rabuse et al. | 428/194 |
| 3,599,240 | 8/1971 | Shapur | 2/75 |
| 3,946,443 | 3/1976 | Knight | 2/82 |

*Primary Examiner*—Werner H. Schroeder

*Assistant Examiner*—Doris L. Troutman

*Attorney, Agent, or Firm*—Duckworth, Hobby, Orman, Allen & Pettis

[57] ABSTRACT

A pocket sized disposable rain protector including a thin flexible plastic canopy with a window or viewing port, wherein the plastic canopy is dimensioned and configured to at least partially surround the head, shoulders and entire human torso down to about the knees. The plastic sheet from which the canopy is made is treated with a cohesion inhibitor in the form of an electrostatic charge placed on opposite surfaces of the plastic sheet to permit easy opening of the protector. The protector is fitted over the top of and partially supported by the user's head and upon being folded will slip into a pocket size envelope.

6 Claims, 2 Drawing Figures

FIG. 1
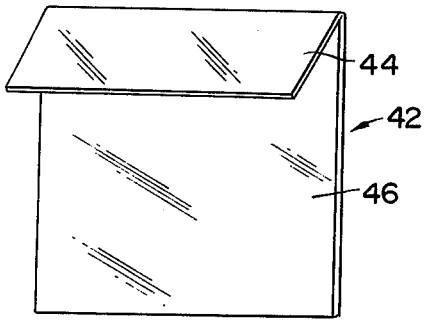
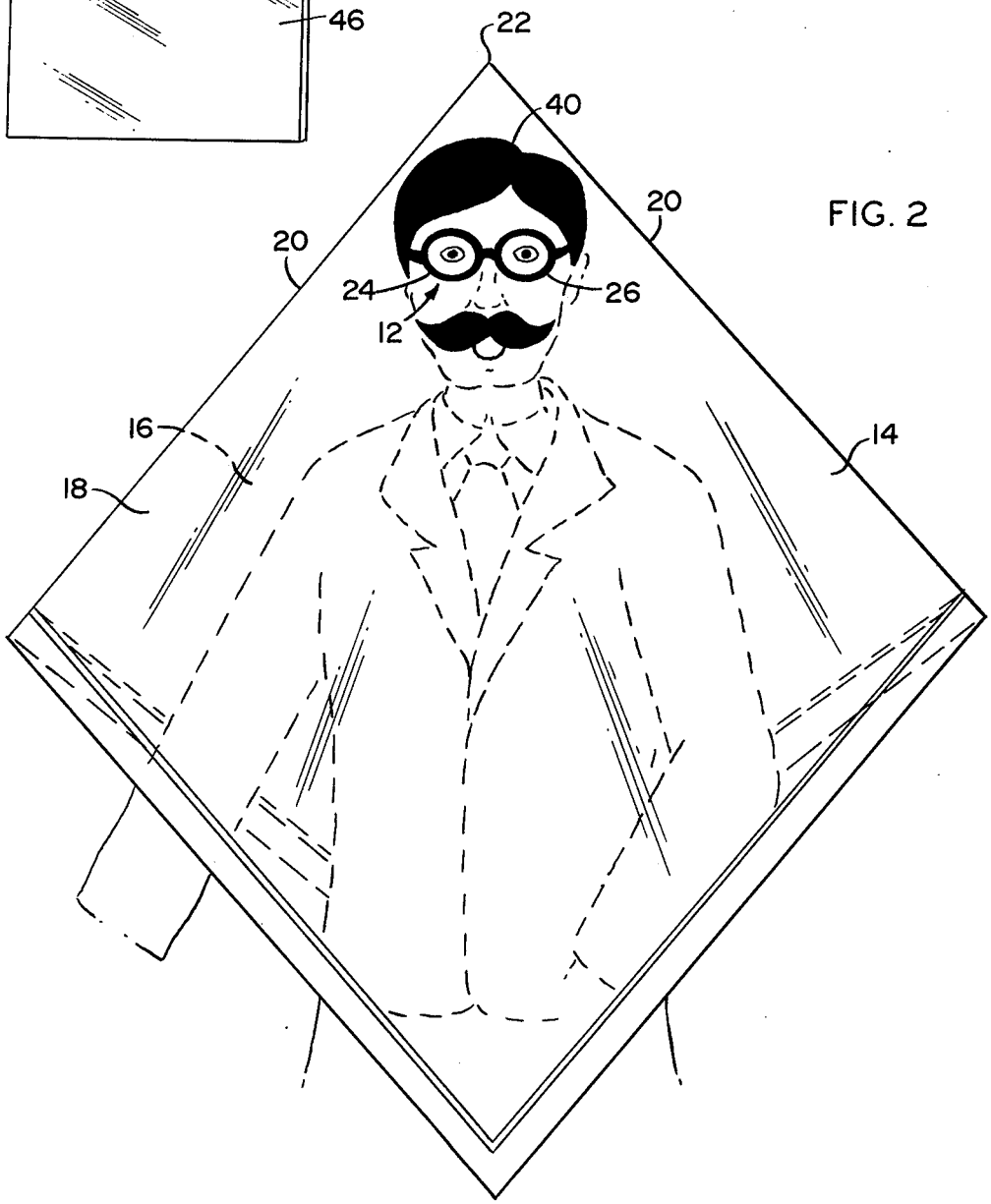
FIG. 2
FIG. 3
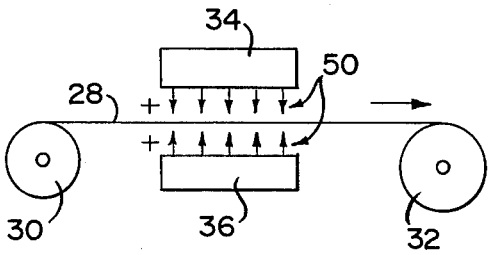

DISPOSABLE RAIN PROTECTOR

BACKGROUND OF THE INVENTION

1. Field of the Invention

A pocket sized rain protector with flexible plastic as a shield against the elements which is disposable after use.

2. Description of the Prior Art

There are many different types of umbrella or rain protector designs. Some of these are classed as emergency or pocket sized umbrellas for use when inclement weather is encountered but was not anticipated. A number of these known umbrellas, as demonstrated by the prior art, have various problems which render them at least inconvenient.

The principal problem with most emergency umbrellas is their size and/or configuration. The element shield, frame and handle in prior art umbrellas frequently render them unsuitable for convenient or efficient pocket carrying.

Another problem typical of emergency umbrellas is the insufficient coverage or protection offered by the element shield to the user. This is frequently due to the attempt to cut down on the dimensions of the umbrella structure in order to accomplish more efficient disposal and carrying. Further, the material used as an element shield is often bulky and therefore unsatisfactory for use in a pocket size umbrella.

While relatively new plastic materials are now commercially available which would offer a potential solution to the problem of bulkiness of the element shield material, the ability to unfold such material is sometimes a problem. More specifically, when the plastic material is thin enough to be suitable for a pocket size umbrella, the nature of the plastic itself is such that the element shield sticks together and does not deploy easily. This is due largely to the inherent tendency of the plastic material to adhere to itself.

There is a further problem in that previous pocket sized umbrellas are generally expensive to make. It was therefore not practical to dispose of such structure after one use. The small size and relatively complex design presents the problem to the user of repacking a pocket sized umbrella which is wet and difficult to reduce to the necessary dimensions.

Thus, a need exists for a pocket sized rain protector with an element shield of sufficient size to protect at least the upper half of the human torso. In addition, the design and structure of such rain protector, as well as the material from which it is made allow the rain protector to be purchased for a price sufficiently low enough to allow the rain protector to be disposable.

SUMMARY OF THE INVENTION

The present invention is a device for protection of the user from the elements such as rain, snow, wind and the like. Further, the invention is pocket sized and designed and structured for disposal after use. It is capable of efficient storage and opening which affords the user more than adequate protection from the weather.

Accordingly, the disposable rain protector comprises two plastic sheets with each plastic sheet having two adjacent edges permanently fused with the corresponding two adjacent edges of the other plastic sheet. This forms a canopy with a cone-like structure similar to an inverted ice cream cone. The size and shape of the sheets are such as to permit the sheets to drape over or enclose the head, shoulders and the upper torso of the user. Window apertures are formed in the canopy to ease viewing and to allow the entry of air to prevent moisture build-up and allow breathing.

Further, these plastic sheets have formed thereon a cohesion inhibitor in the form of a positive electrostatic charge to aid the opening of the device by overcoming any natural tendency of the material of the sheet to adhere together. Since it is commonly acknowledged that most objects on this earth, including humans, carry a positive charge, the existence of a positive charge on the sheet material comprising the canopy means will keep the sheet from adhering to the human body. The positive charge is thereby placed on opposite surfaces of the sheet material by any conventional means which would be applicable to accomplish the proper orientation of the charge on the sheet.

Animated characters, such as cartoon figures or like indicia are painted or otherwise formed on the canopy so as to utilize the window apertures as eyes for animated characters or appropriate figures.

The rain protector means further comprises a plastic envelope including a pouch and a flap. The flap adhesively engages the pouch so as to secure the canopy within the envelope. The disposable protector operates in the following manner. In its folded state the canopy means is contained within the pocket size envelope. The envelope is kept in one's pocket, purse, glove compartment, boat, lunchbox or other equally useful places where it can be available for rain protection. To use the disposable rain protector, the adhesive flap is opened, the rain protector is removed and unfolded. The canopy is then positioned over the user's head with the head fitting in the upper portion of the cone of the canopy and partially supporting the canopy. The canopy extends downward over the user's head, shoulders and upper torso. Once the canopy is no longer needed, it can be disposed of or dried, refolded by the user, and reinserted into the envelope for repeated use.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a full understanding of the nature and objects of the invention, reference should be had to the following detailed description taken in connection with the accompanying drawings in which:

FIG. 1 is a front perspective view of an envelope or pocket sized pouch into which the protector after being folded will be contained.

FIG. 2 is a front plan view of the disposable rain protector in use showing the window apertures and the animated characters painted thereon.

FIG. 3 is a schematic view of a means of application of electric charge to the protective means of the present invention.

Similar reference characters refer to similar parts throughout the several views of the drawings.

DETAILED DESCRIPTION

FIG. 1 shows disposable rain protector, generally indicated as 10, in use and shows window means, generally indicated as 12, located in canopy means 14. Canopy means 14 comprises first and second plastic sheet means 16 and 18, respectively. Two adjacent edges of first plastic sheet means 16 are permanently fused with two adjacent edges of second plastic sheet means 18 so as to define an L-shaped fused interconnection 20 of first plastic sheet means 16 with second plastic sheet means 18. The two adjacent edges of both plastic sheet means 16 and 18 oppositely disposed from the two adjacent edges forming the L-shaped fused interconnection are left unfused. When the two plastic sheet means are in open, spaced apart position relative to each other with corner 22 of the L-shaped fused interconnection 20 in an upright disposition, the canopy means 14 forms a cone-like structure similar to an inverted ice cream cone. Window means 12 in the preferred embodiment of the present invention comprises two circular aperture means 24 and 26 formed within the canopy means. Aperture means 24 and 26 are disposed and configured so as to provide clear forward vision for the user and also acts as an entrance for air which prevents moisture condensing on the interior of the canopy means 14. However, any aperture configured and disposed for clear vision could be used in the present invention.

An important feature of the present invention further comprises the provision of a cohesion inhibitor means introduced to canopy means 14. In the preferred embodiment, canopy means 14 comprises relatively thin, transparent plastic sheeting. In practice, plastic sheeting such as is used in the invention adheres to itself, rendering the opening of tightly packed plastic sheeting a difficult task. To prevent the plastic sheeting from adhering to itself and adhering to the user's face, it is treated with a cohesion inhibitor means. In the preferred embodiment shown in FIG. 2 the plastic sheet comprising the canopy means is subject to a positive (+) electric charge on opposite surfaces thereof. This charge application may generally be indicated as 50. Electrostatic charge generating means 34 and 36 may comprise any of numerous conventional or known designs. The specific structure of the charge applicator 34 does not per se form part of the present invention. In operation, the positive charge 38 may be applied to the material comprising the plastic sheet prior to its being formed into the size and shape of the sheet means 16 and 18. Accordingly, a supply 30 may be fed into the charge generating means 34 and 36 exposed to opposite surfaces of the material. After placement of charge thereon the material then passes to material take-up means 32, as indicated by the directional arrow (FIG. 3).

Animated characters, such as cartoon figures 40, are painted on the canopy means 14 as to utilize aperture means 24 and 26 as eyes for the animated characters.

The rain protector means 10 further comprises a plastic envelope 42 and when canopy means 14 is in its folded disposition as hereinafter described, it is contained therein. The plastic envelope 42 comprises a flap 44 and a pouch 46. The flap 44 removably and adhesively engages the pouch 46 so as to secure the canopy means 14 within the envelope 42.

The disposable rain protector is operated in the following manner. The canopy means 14 comprising two plastic sheet means approximately 30 inches by 30 inches each, are folded six times so as to form a final end product measuring approximately 4 inches by 4 inches and about ¾ of an inch thick. This canopy means 14 is then slipped into the plastic envelope 42 and the flap 44 is adhesively attached to the pouch 46. The user can place the envelope with the canopy 14 contained therein in his pocket, purse, glove compartment, boat, lunchbox or other equally useful places where it can be available for rain protection. To use the disposable rain protector, the flap 44 is opened, the rain protector is removed and unfolded. The cohesion inhibitor means or positive charge 50 introduced to opposite surfaces of canopy means 14 creates a repelling action within the canopy means 14 allowing it to unfold with ease. Canopy means 14 is then positioned to at least partially enclose approximately the head and upper torso of the user. The canopy means is rotated so that the user may see out through window means 12. Window means 12 provides for clear forward vision for the user and also acts as an entrance for air which prevents moisture condensing on the interior of the plastic canopy means 14. Once the canopy means 14 is no longer needed, it can be disposed of or dried, refolded by the user, and reinserted into the envelope 42 for repeated use.

It will thus be seen that the objects set forth above, among those made apparent from the preceding description, are efficiently attained and, since certain changes may be made in carrying out the above method and articles without departing from the scope of the invention, it is intended that all matter contained in the above description shall be interpreted as illustrative and not in a limiting sense.

It is also to be understood that the following claims are intended to cover all the generic and specific features of the invention herein described and all statements of the scope of the invention, which, as a matter of language, might be said to fall therebetween.

Now that the invention has been described, What is claimed is:

1. A disposable rain protector comprising: canopy means formed from a flexible sheet material and defining a predetermined configuration; and cohesion inhibitor means comprising a positive electrostatic charge disposed on opposite surface portions of said flexible sheet material and coextensive with said surface portions, whereby adherence of said flexible sheet material to itself and to the user thereof is substantially reduced.

2. A disposable rain protector as in claim 1 wherein said canopy means further comprises first and second sheet means, said first and second sheet means each including at least one edge disposed in adjacent relation to one another, said adjacently disposed edges of each of said sheet means permanently attached to one another, whereby said attached sheet means define a substantially cone shaped configuration.

3. A disposable rain protector as in claim 1 wherein said canopy means further comprises window means within canopy means.

4. A disposable rain protector as in claim 3 further comprising indicia formed on designated portions of the outer surface of said canopy means, said window means comprising two aperture means disposed in aligned relationship to said indicia, whereby said indicia and said apertures define a predetermined design.

5. A disposable rain protector as in claim 1 further comprising envelope means disposed and configured to contain said canopy means therein.

6. A disposable rain protector as in claim 5 wherein said envelope means further comprises pouch means and flap means, said flap means removably and adhesively engaging said pouch means when in a securing position, whereby said canopy means is enclosed within said envelope.

* * * * *